US005890319A

United States Patent [19]

Haeck et al.

[11] Patent Number: 5,890,319

[45] Date of Patent: Apr. 6, 1999

[54] REMOVABLE MULLION ASSEMBLY

[75] Inventors: Paul J. Haeck, Carmel; Raymond Peeler, Westfield, both of Ind.

[73] Assignee: Detex Corporation, Braunfels, Tex.

[21] Appl. No.: 936,268

[22] Filed: Sep. 24, 1997

[51] Int. Cl.[6] ..... E06B 5/00

[52] U.S. Cl. ..... 49/365; 49/7

[58] Field of Search ..... 49/7, 365, 8; 52/210

[56] References Cited

U.S. PATENT DOCUMENTS

| | | | |
|---|---|---|---|
| 3,000,062 | 9/1961 | McCandless . | |
| 3,319,382 | 5/1967 | Hand . | |
| 4,012,066 | 3/1977 | Salvatore | 49/7 X |
| 4,146,994 | 4/1979 | Williams | 49/7 X |
| 4,161,804 | 7/1979 | D'Hodge et al. | 49/7 X |
| 4,865,367 | 9/1989 | Choi | 49/7 X |
| 5,427,420 | 6/1995 | Moore . | |
| 5,435,102 | 7/1995 | McCarthy . | |
| 5,450,697 | 9/1995 | Prucinsky et al. | 49/365 X |
| 5,464,259 | 11/1995 | Cohrs . | |
| 5,471,792 | 12/1995 | Higgins . | |
| 5,527,074 | 6/1996 | Yeh . | |

*Primary Examiner*—Jerry Redman
*Attorney, Agent, or Firm*—Strasburger & Price, L.L.P.; Matthew J. Booth

[57] ABSTRACT

The removable mullion assembly allows a mullion to be removed, thereby allowing wider objects to pass through double doors. The top fitting of the assembly includes a spring loaded retaining bolt which locks the mullion in place. A locking mechanism attached to the top fitting allows the retaining bolt to be disengaged from the mullion. However, in the event of a fire, a meltable platform within the top fitting releases a deadlock, which mechanically blocks the retaining bolt from disengaging the mullion.

15 Claims, 5 Drawing Sheets

REMOVABLE MULLION ASSEMBLY

FIELD OF THE INVENTION

This invention pertains to a removable mullion assembly for a double door. Specifically, the invention pertains to a top fitting which allows the removable mullion to be locked in position in the door opening and which prevents unlocking the mullion in the event of a fire.

BACKGROUND OF THE INVENTION

A mullion is a vertical member that allows two single doors to be used in a double door opening. A mullion is installed in the center of the door opening near the meeting edges of a pair of doors. The mullion is attached to the sill by a bottom fitting and to the head by a top fitting. Two strikes are mounted on opposing sides of the mullion, one for each of the two single doors.

It is often desirable to remove the mullion to provide a full double door opening. For example, if the double doors are on an auditorium, the mullion can be removed to allow large equipment to be brought into the room. Removable mullions are known in the prior art, as are removable mullions having locks to prevent unauthorized removal. For example, U.S. Pat. No. 3,000,062 to McCandless discloses a removable mullion that can be attached to a double door frame without the use of fasteners.

Often, the double doors to a large public room are also rated as fire doors. Fire doors typically have a locking mechanism between the doors with a meltable member. In the event of a fire, the meltable member in the lock is destroyed by the heat of the fire, thus keeping the doors from being opened, allowing the fire to spread. For example, U.S. Pat. No. 5,527,074 to Yeh discloses a fire protection door lock. The Yeh '074 lock includes a plastic member that restrains a spring bolt. When the plastic member melts, the spring bolt engages. Likewise, U.S. Pat. No. 5,464,259 to Cohrs et al. discloses a door latch with a meltable fuse mechanism. The Cohrs et al. '259 device is used on a door with a push pad that translates a latch assembly. When the fire fuse melts, the translation linkage is disrupted. A need exists for a similar fire safety element in the top fitting of a removable mullion assembly. Such a top fitting should allow for easy installation and removal of the mullion. It should also prevent removal of the mullion when a fire is present.

SUMMARY OF THE INVENTION

The present removable mullion assembly allows a mullion to be removed, thereby allowing wider objects to pass through double doors. The top fitting of the assembly includes a spring loaded retaining bolt which locks the mullion in place. A locking mechanism attached to the top fitting allows the retaining bolt to be disengaged from the mullion. However, in the event of a fire, a meltable platform within the top fitting releases a deadlock, which mechanically blocks the retaining bolt from disengaging the mullion.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE INVENTION

Figure 1:
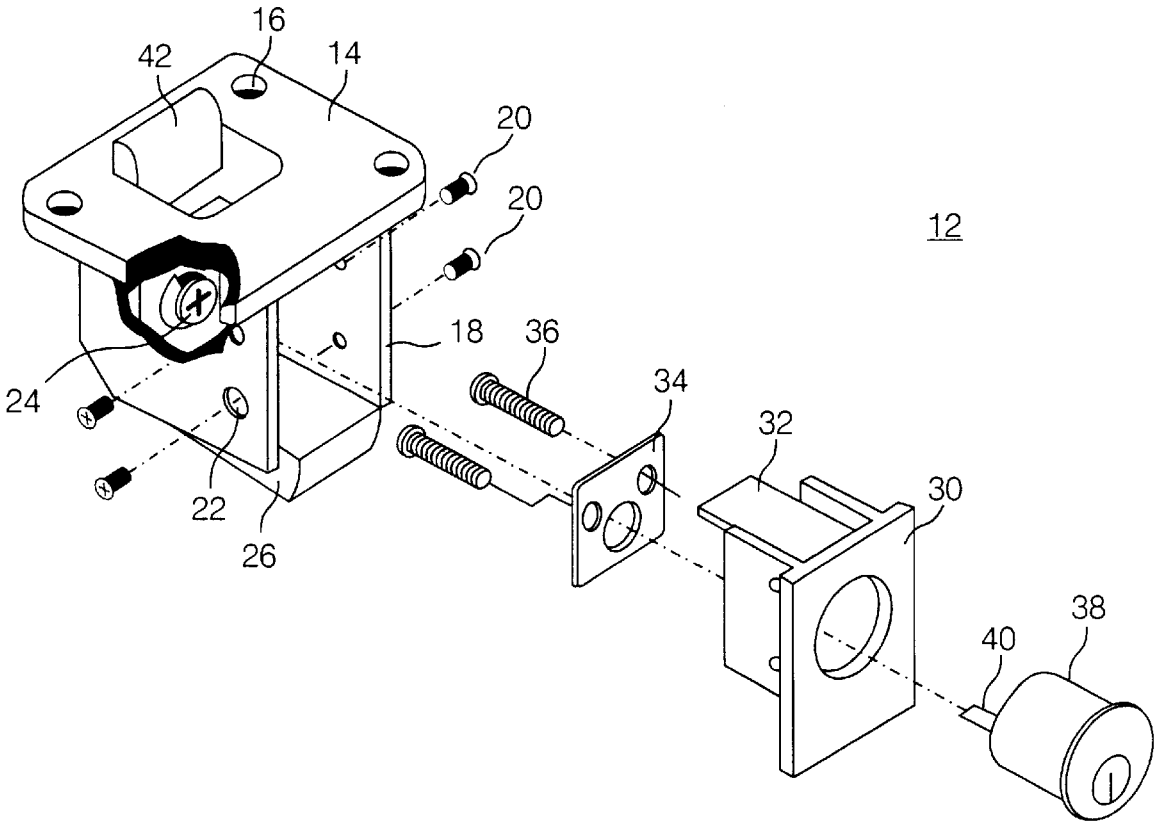
FIG. 1 is a partially cutaway, exploded perspective view of a top fitting for locking a removable mullion in accordance with the invention.
Figure 2:
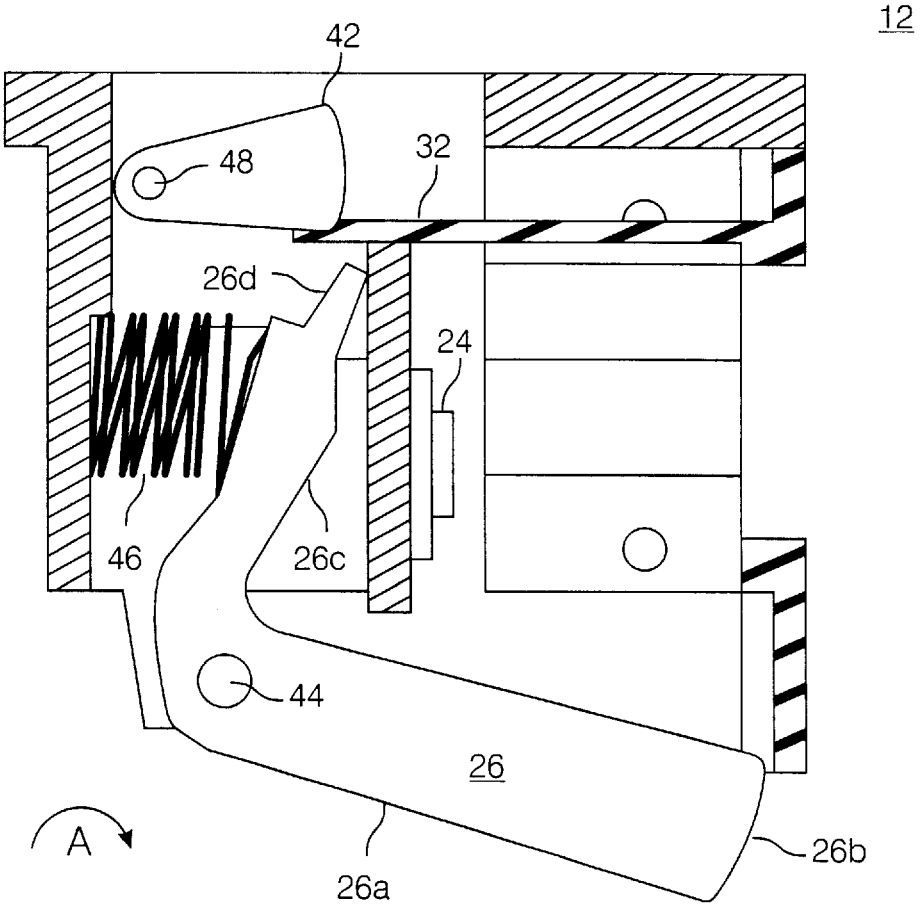
FIG. 2 is a side sectional view of the top fitting of FIG. 1.

The removable mullion assembly 10, illustrated in FIGS. 1 to 5, overcomes many of the disadvantages found in the prior art. The assembly 10 includes a top fitting 12 for locking a removable mullion 50 between a head 2 and a sill 4 in a double doorway. The top fitting 12 comprises a main housing or frame 14 having four holes 16 for use in mounting the top fitting 12 to the head 2. The mullion 50 is first anchored into a sill fitting 60 mounted to the sill. Next, the mullion 50 is rotated into a position adjacent to the top fitting 12. A retaining bolt 26 in the top fitting 12 locks the mullion in place.

FIG. 1 provides an exploded view of the top fitting 12. The fitting includes a frame 14 which is mounted to the head 2 with fasteners accepted by holes 16. The frame 14 also includes side walls 18 with holes 22. Fasteners 20 are accepted by holes 22 and are used to secure a locking mechanism housing 30. A locking mechanism 38 is attached to the housing 30 by means of fasteners 36 which fit through and attach a back plate 34. The locking mechanism can be any suitable lock, but in one embodiment, is a cylindrical lock having a pin 40 which moves in response to a key turning in the lock.

The top fitting 12 also includes a retaining bolt 26 which is possible pivotally attached to the frame 14 by pin 44. The bolt is biased in a down position by a spring 46, best shown in FIG. 2. When a mullion 50 engages the top fitting, it pivots in the direction shown by arrow A. A top surface of the mullion presses against its surface 26*a*, raising the mullion. This allows the mullion to achieve a vertical position. Once the mullion is vertical, the retaining bolt 26 is forced by spring 46 back into its lower position. The mullion is a generally hollow with open ends. Thus, the retaining bolt 26 drops into the top opening of the mullion. The mullion cannot rotate past the vertical position because of the sill fitting 60. Further, it cannot be removed because the surface 26*b* of the retaining bolt 26 prevents it. Surface 26*b* is also called the mullion engagement surface. To remove the mullion, a key must be turned in the locking mechanism 38. When the key is turned, the pin 40 is moved against the surface 26*c* of the retaining bolt 26 through coupling 24, thus lifting the bolt. The mullion can then be removed.

In the event of a fire, the key mechanism must be disabled so that even a person with a key cannot remove the mullion. Thus, any movement of the retaining bolt must be entirely blocked. This is accomplished through the use of a deadlock 42. The deadlock 42 is attached to the frame 14 by pin 48. The deadlock 42 is supported in a raised position by a platform 32. The platform 32 can be integral with the locking mechanism housing 30. The platform 32 is formed of meltable material, such as nylon. In the presence of a fire, the platform 32 deforms or melts from the heat, allowing the deadlock 42 to drop against surface 26*d* of the retaining bolt 26. Surface 26*d* is also called the deadlock engagement surface. The deadlock thereby prevents any motion of the retaining bolt which would allow the removal of the mullion. The deadlock 42 also prevents the retaining bolt 26 from disengaging the mullion 50 during a fire due to the thermal expansion of the mullion. Thus, the present invention provides a simple, reliable means for locking a removable mullion and for preventing the mullion from being unlocked during a fire.

Figure 3:
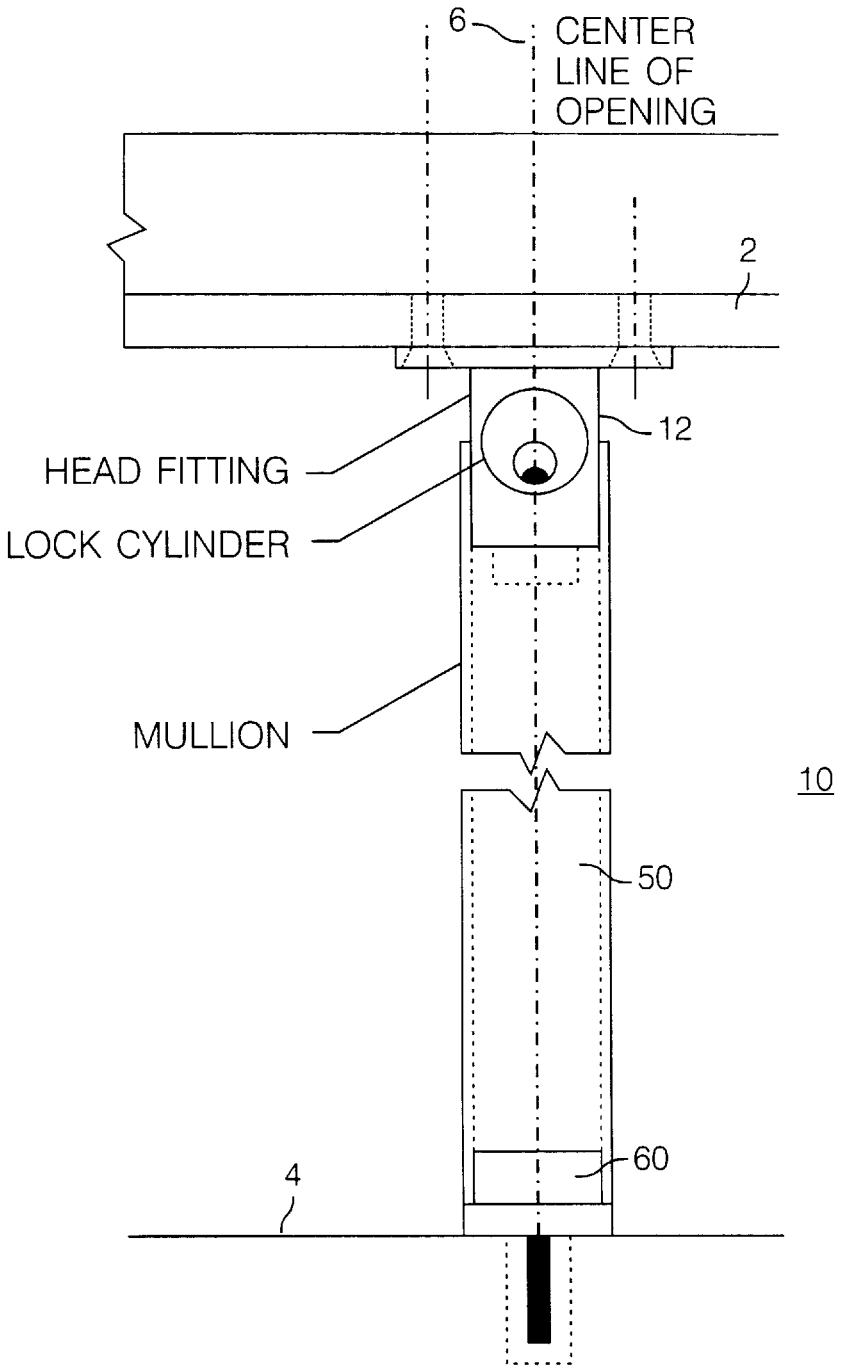
FIGS. 3, 4, and 5 illustrate the general method of installing the top fitting.
Figure 4:
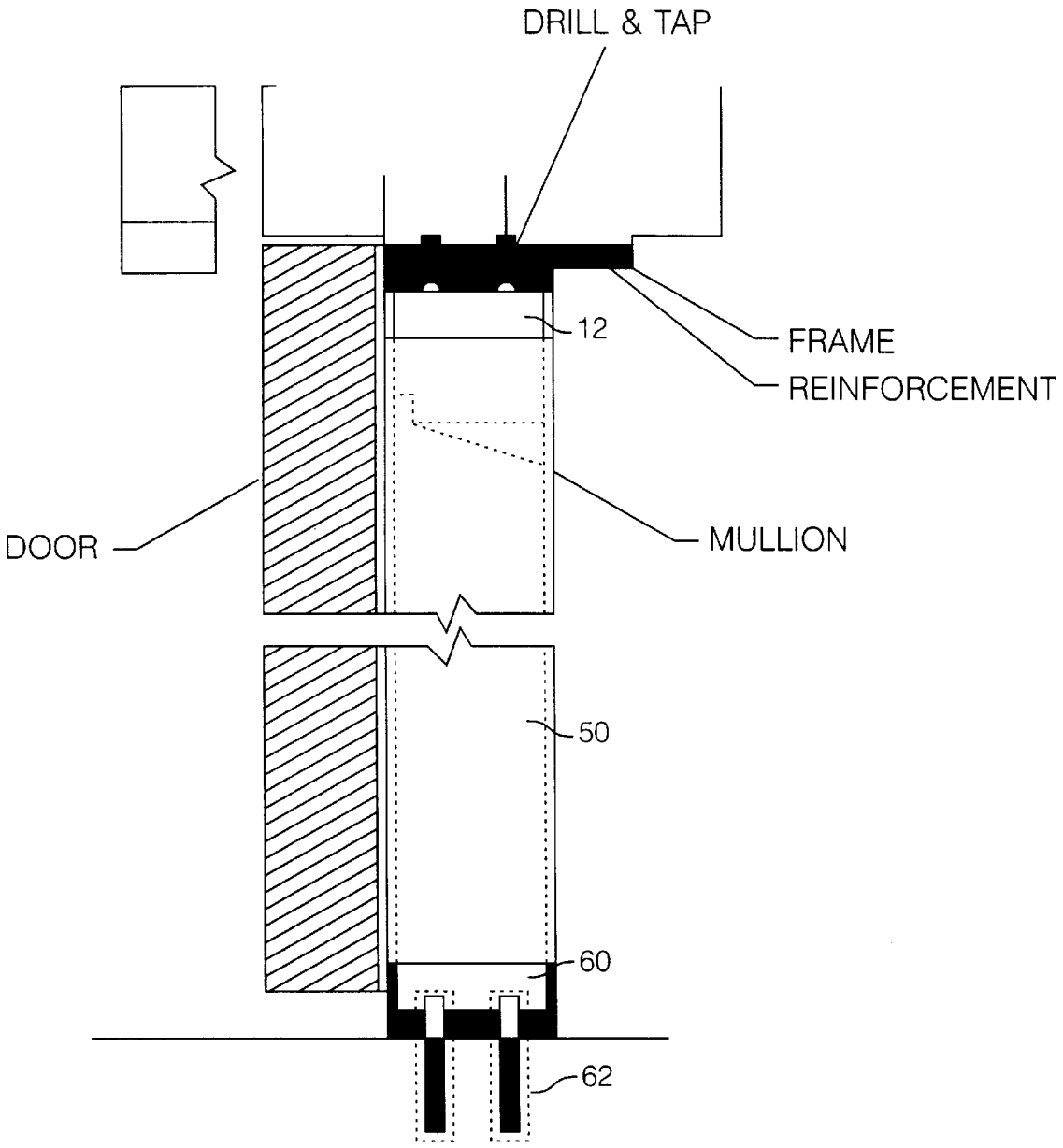
Figure 5:
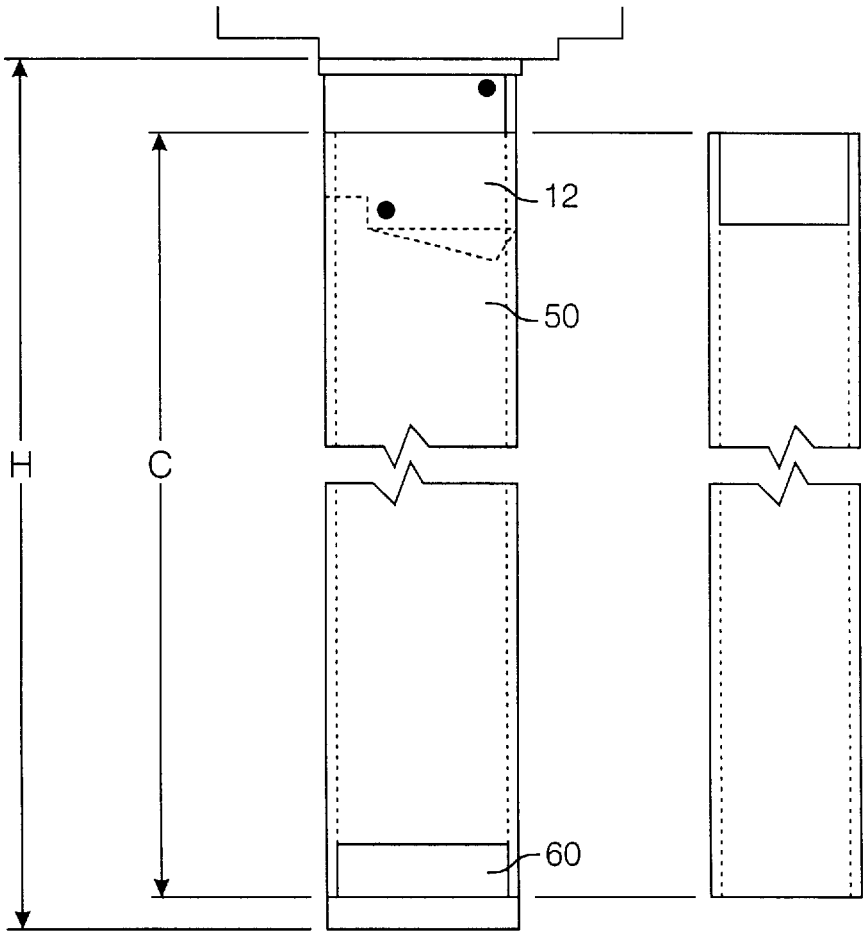

FIGS. 3, 4, and 5 illustrate a method of installing the top fitting at the head 2 and the sill fitting 60 at the sill 4 of a doorway. First, a centerline 6 must be marked to determine the center of the width of the door. Next, the head fitting 10 is placed at the head 2 of the frame. A center notch on the top fitting 12 is aligned with the centerline mark. The doors are then closed so as to abut the notched side of the top fitting 12. Marks are then made on the head 2 for accepting fastening screws for attaching the frame 14 of the top fitting 12.

Next, the locking mechanism 38 is installed into the locking mechanism housing 30. The pin 40 is trimmed as required. The installer then raises the deadlock 42 with one finger and slides the locking mechanism housing into the frame 14. The installer should ensure that the pin 40 engages the retaining bolt surface 26*c* while the platform 32 slides under the deadlock 42. The housing 30 can then be attached to the frame with screws 20. The frame 14 is then attached to the head.

The mullion 50 should then be trial fit for length. If it is too long, the installer should measure the distance H from the bottom of the stop on the frame to the floor. He should then subtract a predetermined amount, e.g. 1 ¾ inch, from this measurement, mark the mullion tube and cut the end with no cutout. The mullion, having a length C, is then placed on the sill fitting 60 at the floor and abut the mullion to the doors. The installer should then align the centering notches of the fitting with the marks made on the head. If there is a threshold, it should be cut so that the sill fitting is resting on the nonflammable flooring. Next, the mullion should be carefully removed. The floor should be marked for the location of drill holes 62, shown in FIG. 4. The sill fitting 60 should then be attached to the sill 2. The mullion 50 is again placed on the now-secured sill fitting and pivoted upward into place. If there is too much gap, shims can be installed.

Although preferred embodiments of the present invention have been described in the foregoing Detailed Description and illustrated in the accompanying drawings, it will be understood that the invention is not limited to the embodiments disclosed, but is capable of numerous rearrangements, modifications, and substitutions of steps without departing from the spirit of the invention. Accordingly, the present invention is intended to encompass such rearrangements, modifications, and substitutions of steps as fall within the scope of the appended claims.

We claim:

1. A removable mullion assembly with a meltable lock assembly, comprising:

(a) a frame coupled to a removable mullion assembly;

(b) a retaining bolt pivotally affixed within the frame and movable between a locked position and an unlocked position;

(c) a meltable deadlock platform attached to the frame; and (d) a deadlock pivotally affixed to the frame, wherein the deadlock platform prevents the deadlock from engaging the retaining bolt.

2. The top fitting of claim 1 further comprises a spring attached between the housing and the retaining bolt, wherein the spring biases the retaining bolt in a locked position.

3. The top fitting of claim 1 wherein said deadlock is disposed above the retaining bolt.

4. The top fitting of claim 1 further comprises a locking mechanism attached to said frame.

5. The top fitting of claim 4 wherein said locking mechanism comprises a pin in contact with the retaining bolt, wherein the pin moves between a first and second position, and said movement translates the retaining bolt between the locked and unlocked positions.

6. The top fitting of claim 1 wherein said locking mechanism housing is deformable.

7. The top fitting of claim 1 wherein said retaining bolt comprises a mullion engagement surface.

8. The top fitting of claim 1 wherein said retaining bolt comprises a deadlock engagement face.

9. The top fitting of claim 1 wherein said retaining bolt comprises a locking mechanism housing attached to said frame for positioning a locking mechanism.

10. A removable mullion assembly comprising:

(a) a mullion; and (b) a top fitting for removably engaging the mullion, wherein said top fitting includes a retaining bolt having a mullion engagement surface and a deadlock, and wherein said deadlock is removed from the retaining bolt by a meltable platform.

11. The removable mullion assembly of claim 10 further comprises a sill fitting for engaging an end of the mullion.

12. The removable mullion assembly of claim 10 further comprises a locking mechanism for disengaging the retaining bolt from the mullion.

13. The removable mullion assembly of claim 10 wherein said mullion is generally hollow having two open ends.

14. The removable mullion assembly of claim 11 wherein said sill fitting is anchored to a sill.

15. The removable mullion assembly of claim 10 wherein said top fitting is anchored to a head.

* * * * *

UNITED STATES PATENT AND TRADEMARK OFFICE

CERTIFICATE OF CORRECTION

PATENT NO. : 5,890,319
DATED : April 6, 1999
INVENTOR(S) : Haeck, et. al.

It is certified that error appears in the above-indentified patent and that said Letters Patent is hereby corrected as shown below:

Column 4, line 29, change "engagement face. " to--engagement surface.--

Signed and Sealed this

Thirtieth Day of November, 1999

*Attest:*

*Attesting Officer*

Q. TODD DICKINSON

*Acting Commissioner of Patents and Trademarks*